US005470458A

United States Patent [19]

Ripley et al.

[11] Patent Number: 5,470,458

[45] Date of Patent: Nov. 28, 1995

[54] METHOD FOR THE RECOVERY OF BLACK OIL RESIDUES

[76] Inventors: Ian Ripley, 75 The Willows Marton, Middlesborough, Cleveland, United Kingdom, TS7 8BP; Anthony H. Needham, 50 Thames Avenue, Guisbrough, Cleveland, United Kingdom, TS14 8AF

[21] Appl. No.: 976,724

[22] Filed: Nov. 16, 1992

Related U.S. Application Data

[63] Continuation of Ser. No. 464,866, Jan. 16, 1990, abandoned.

[30] Foreign Application Priority Data

Feb. 1, 1989 [GB] United Kingdom ..... 8902116

[51] Int. Cl.[6] ..... C10G 70/04

[52] U.S. Cl. ..... 208/370; 137/13

[58] Field of Search ..... 208/13, 370, 177; 137/13, 14

[56] References Cited

U.S. PATENT DOCUMENTS

| | | | |
|---|---|---|---|
| 1,004,391 | 1/1911 | Dunlap | 208/370 |
| 3,027,319 | 3/1962 | Meyer et al. | 208/370 |
| 3,136,711 | 6/1964 | Glaser et al. | 208/370 |
| 3,144,036 | 8/1964 | Rice, Jr. | 137/14 |
| 3,234,122 | 2/1966 | Allibone | 208/370 |
| 3,622,071 | 11/1971 | Coggins | 137/13 |
| 3,646,950 | 3/1972 | Takehisa et al. | 137/14 |
| 3,678,243 | 7/1972 | Ando et al. | 137/13 |
| 3,919,074 | 11/1975 | Gatsis | 208/48 R. |
| 3,943,964 | 3/1976 | Asselman | 137/13 |
| 4,124,495 | 11/1978 | Bazell | 208/370 |
| 4,126,182 | 11/1978 | Allen et al. | 137/13 |
| 4,126,542 | 11/1978 | Carlsmith | 137/13 |
| 4,230,138 | 10/1980 | Tanaka | 137/13 |
| 4,285,805 | 8/1981 | Stegelman | 208/177 |
| 4,334,605 | 6/1982 | Hitt | 208/177 |
| 4,778,586 | 10/1988 | Bain et al. | 137/13 |
| 4,882,037 | 11/1989 | Kalnes et al. | 208/177 |
| 4,945,933 | 8/1990 | Krajicek et al. | 134/167 R |
| 4,976,278 | 12/1990 | Ripley et al. | 137/15 |
| 5,050,628 | 9/1991 | Ripley et al. | 137/15 |
| 5,085,242 | 2/1992 | Ripley et al. | 137/13 |

FOREIGN PATENT DOCUMENTS

| | | | |
|---|---|---|---|
| 0988672 | 1/1983 | U.S.S.R. | 208/370 |

OTHER PUBLICATIONS

"Heat & Transfer Exchanges" *Petroleum Refinery Eng.* W. L. Nelson, McGraw Hill 1958, pp. 580–585

*Primary Examiner*—Helane Myers

[57] ABSTRACT

The invention is directed to the thermal mobilization of black oil residues by direct and/or indirect heating whereby the mobilized residues are then removed from the tank by a localized negative pressure means. The removed black oil residues are then treated to recover an oil which may be utilized alone or combined with other petroleum products.

24 Claims, 7 Drawing Sheets

METHOD FOR THE RECOVERY OF BLACK OIL RESIDUES

This is a continuation of application Ser. No. 07/464,866, filed on Jan. 16, 1990, now abandoned.

RELATED PATENT APPLICATIONS

This application is related to the following commonly assigned patent applications which were filed on the same date as this application:

- U.S. application Ser. No. 07/464,859, entitled: Tank Entry Procedure And Apparatus
- U.S. application Ser. No. 07/464,873, entitled: Method And Apparatus For The Removal Of Black Oil Residues From Tanks
- U.S. application Ser. No. 07/464,867, entitled: Method And Apparatus For Introducing And Positioning A Tank Contents Removal Means.

BRIEF DESCRIPTION OF THE INVENTION

The economical and efficient recovery of black oil residues comprising sludges, slop oils, pitches, waxes, bottoms, and the like, which typically build up in storage tanks housing crude oil/heavy fuel oil, and the like, to provide a usable oil which may be used alone as a fuel or blended with other oils and used as a fuel or feedstock.

BACKGROUND TO THE INVENTION

In the course of handling crude oil and refined petroleum products, the small percentage of residues which are present accumulate in storage holding areas because with time in storage such residues separate from the basic crude oil or the refined petroleum. The amounts of these residues that accumulate depends on the crude oil or refined petroleum being stored. Complicating this condition is the fact that in one way or another, water and siliceous materials are introduced to the holding areas and accumulate with the residues. These residues have fuel value. However, gaining access to them within the holding areas is difficult until the holding area is free of its normal storage, and even then, the recovery of the residues is a problem. In the past, after the area was free of the normal storage, crews were sent into the area and they shoveled the residues out. Vacuum suction has been used to remove the separate layer of water either before or after the work crews entered the area. Because the resolution of this problem was so labour intensive and hazardous, and carried out irregularly, there has been a lessened inclination to clean the storage holding areas, consequently many of them have large accumulations of such residues and water. This has introduced a massive problem for the refiner which involves serious economic and enviromental penalties.

Owing to an inability to recover these residues effectively and economically and to render them useful as fuels, residues of crude oil and/or heavy fuel oil, and the like, have low commercial value. They commonly have high viscosities, and contain, among other things, insoluble carbonaceous particulate matter, sand, other inorganic particulate materials and/or water. As a result, they have been discarded into pits or ponds which over time have become serious enviromental problems and imposed significant problems in land utilization.

The complexity of the problem deserves a more thorough discussion. Crude oils, heavy fuel oils, and the like, are typically, stored in holding tanks having a capacity of from about $2.5\times10^5$ to $15\times10^6$ gallons or more. They may be left in the tank for weeks at a time, consequently insoluble residues have ample opportunity to precipitate within the oil in the tank and settle to the bottom of the tank where the insoluble residues may become assimilated with any water layer present.[1] With time, the volume occupied by these residues (and sludges) within the storage tank becomes appreciable. This volume will continue to build with each succeeding charge of oil into the storage tank thereby reducing the storage volume of the tank for the desirable crude oils and heavy fuel oils.

1. Water has a higher specific gravity than oil and settles to the bottom of the tank.

Eventually, either to maximize and restore the holding capacity of the tank or to empty the tank for purposes of inspection or repair, and the like considerations, these residues (sludges) have to be removed from the tank. As mentioned earlier, the problem had been met by workers entering the tank through its manways or an upper opening (e.g., top cover), and proceeding to shovel the sludge out of the tank. Not only is this primitive technique labour intensive, and time consuming, resulting in an inordinate amount of downtime for the tank, it also creates serious health and environmental problems. Other sludge removal techniques have been developed including, for example, vacuum suction utilizing negative pressure, dilution with a solvent such as light gas oil/distillate, and the like. While these techniques are perhaps improvements over manual recovery of residues from tanks, they are expensive and still pose health, safety and ecological problems. They give little thought to recovering and treating the removed residues in an economical and efficient manner. In addition, the use of solvents adds a significant cost since the solvent has value in commerce.

The residues shoveled or otherwise taken from the tanks have been carted in batch operations from the tank storage areas to large excavated holes in the ground where they are deposited to create pits or ponds of such residues. These residues eventually transform into pitch. With time, the pits or ponds have grown into substantial enviromental headaches for the refiners and their purlieus.

As the value of petroleum has increased in the past decade, coupled with recognition that the accumulation of residues is a problem that will not go away, and has to be dealt with, more interest has been taken in the energy values of the residues because only in the effective utilization of the residues as a fuel or raw material can the enviroment be cleaned up. Key to energy value attractiveness of these residues are two factors:

1. low cost recovery of the residues from the tanks;
2. low cost purification of the residues which allows them to be blended off either as a fuel or as a refinery raw material.

A need accordingly exists for a process which provides an economical and efficient means for removing crude oil and/or heavy fuel oil residues, and the like, from a storage tank in a safe and ecologically sound manner and which, moreover, also provides for the recovery of such removed residues so that they can be economically utilized. A need also exists for a low cost method for the purification of the residues which allows them to be blended off either as a fuel or as a refinery raw material.

THE INVENTION

This invention is directed to the low cost recovery and purification of residues from storage areas such as tanks without create health hazards or worker entry problems, and allows the continuous removal of residues from a storage tank thereby supporting continuous processes for the purification of the residues for the purpose of recovering fuel and/or raw material values and the downstream purification that allows such continuous recovery and provides a product having significant commercial utility.

This invention relates to a process for the economic and efficient recovery and purification of black oil residues, such as crude oil or heavy fuel oil residues, or other similar such residues, from storage tanks which avoids substantially all of the disadvantages noted above. As a result of this process, the residue is suitable for treatment to provide an oil which can be blended with crude or refined oils in a predetermined concentration to provide a suitable fuel or refinery feedstock.

In particular, the invention relates to a process for the mobilization and removal of black oil residue from an enclosed tank which comprises:

a) heating at least a portion of the black oil residue by a heating means located inside the tank to the extent that at least the portion of the black oil residue becomes mobilized;

b) removing the mobilized black oil residue from the tank by localized negative pressure located at the portion of the residue which has become mobilized;

c) heating the removed mobilized black oil residue to a temperature in the range of between about 50° C. to about 200° C.;

d) feeding the heated black oil residue to a filtration means to remove coarse particulate matter therefrom; and e) passing the filtered, heated black oil residue to process separation whereby substantially all solid sediments and heating medium contained in the filtered black oil residue are removed thereby producing an oil suitable for further refining or blending.

The black oil residue is heated while in the tank enclosure by direct fluid contact with the residue or by indirect heating with a conduit which is in contact with the residue. Direct heating of the black oil residue is effected by contacting the residue while in the enclosure with a heated fluid medium such as hot water. Indirect heating may be effected by circulating, e.g., stem, water, oil or electrical energy through a thermal conduit within the residue.

Mobilization of the residue is typically achieved when its viscosity is thermally brought in the range of from about 20 to 100 centistokes. In the typical case, the concentration of heat provided to the residue in the tank enclosure is desirably sufficient to raise the temperature of the residue in the locale where removal is being effected to a temperature in the range of from about 30° C. to about 100° C. For example, in the direct heating of the residue, one may use water which is at a temperature less than about 95° C. but higher than about 50° C.

The invention contemplates that the heating means, whether direct or indirect, is introduced into the tank through at least one tank manway. The invention also contemplates the use of localized negative pressure within the tank by providing a submersible pump having an inlet end located in the tank in the location of the mobilized black oil residue. The preferred pump employs an Archimedian screw design.

In one embodiment of the invention, a layer of mobilized black oil residue is formed over a layer of water within the enclosure and the localized negative pressure is located at the interface formed by the residue layer and the water layer.

The invention contemplates special apparatus for introducing the pump into the tank through at least one tank manway and locating the pump.

In a preferred aspect of the invention, mobilization and removal of black oil residue from an enclosed tank involves:

a) introducing a heating medium into the black oil residue at a velocity and temperature effective to create a localized turbulent mixture of mobilized black oil residue and heating medium and an adjacent area of nonturbulent mobilized black oil residue, preferably in an area located above the area of localized turbulent mixture;

b) removing the mobilized black oil residue from the adjacent area by localized negative pressure located at the adjacent area of mobilized black oil residue.

c) feeding the heated black oil residue to a filtration means to remove coarse particulate matter therefrom; and d) passing the filtered, heated black oil residue to process separation whereby substantially all solid sediments and heating medium contained in the filtered black oil residue are removed thereby producing an oil suitable for further refining or blending.

In this process embodiment, it is preferred that the heating medium be introduced at a velocity in the range of from about 2 m./sec. to about 15 m./sec. The process is further optimized if the heating medium is introduced at a temperature in the range of from about 30° C. to about 100° C. In the typical practice of this embodiment, a submersible pump is located in the adjacent area while the localized turbulent mixture of mobilized black oil residue is independently created by the introduction of the heating medium through one or more separate pipes into the the area of turbulence. Consequently, the pump, which may operate by positive displacement, creates a negative pressure at the interface between the two areas thereby causing heated residue in the adjacent area to flow into the pump for removal from the tank enclosure.

The process of the invention includes with respect to the mobilization and removal of black oil residue from an enclosed tank comprising:.

a) inserting one or more conduits through at least one manway of the tank such that at least the leading end of the conduit is in contact with the black oil residue;

b) introducing water at a temperature of less than about 95° C. through the conduit at a velocity of about 2 to about 15 m./sec. such that a localized turbulent mixture of mobilized black oil residue and water is created;

c) withdrawing water from the tank, reheating it to a temperature of less than 95° C., and then reintroducing the heated water to the tank through at least one conduit;

d) continuing to withdraw and reintroduce the water until a layer of mobilized black oil residue is formed on top of a layer of water within the tank forming a residue/water interface, preferably the volume of water in the water layer is substantially equal to the volume of black oil residue contained in the tank;

e) introducing a submersible pump, preferably one that employs an Archimedian screw design to transport the mobilized black oil residue, which has a discharge conduit fitted to a tank manway and its inlet end at least slightly above the residue/water interface;

f) removing the mobilized black oil residue from the tank through the discharge conduit of the pump;

g) feeding the heated black oil residue to a filtration means to remove coarse particulate matter therefrom; and h) passing the filtered, heated black oil residue to process separation whereby substantially all solid sediments and heating medium contained in the filtered black oil residue are removed thereby producing an oil suitable for further refining or blending.

The invention includes a process for treating the removed residue which comprises the steps of:

a) heating the removed mobilized black oil residue to a temperature in the range of between about 75° C. to about 175° C.;

b) feeding the heated black oil residue to a filtration means to remove coarse particulate matter therefrom;

c) passing the filtered, heated black oil residue to process separation whereby substantially all solid sediments and heating medium contained in the filtered black oil residue are removed thereby producing an oil suitable for further refining or blending.

In the preferred aspect of this purification step of the invention includes, inter alias:

(a) the temperature of the black oil residue is maintained at a temperature in the range of between about 75° C. to about 175° C. throughout the process;

(b) the process separation comprises one or more of
(i) a decanter centrifuge,
(ii) a high speed vertical disc stack centrifuge,
(iii) a decanter centrifuge in sequence with a high speed vertical disc stack centrifuge.

FIG. **6*a*** is a cross-sectional view of two lengths of conduit and a corresponding coupler used to transport heating medium into the interior of the tank.

Figure 6A:
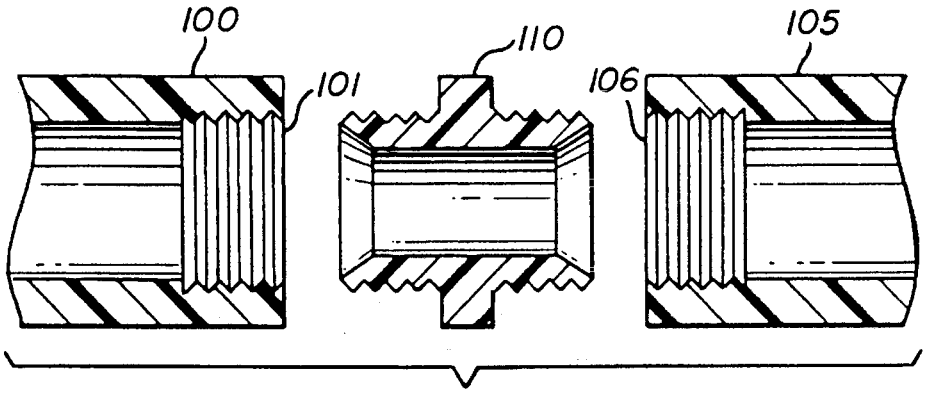
Figure 6B:
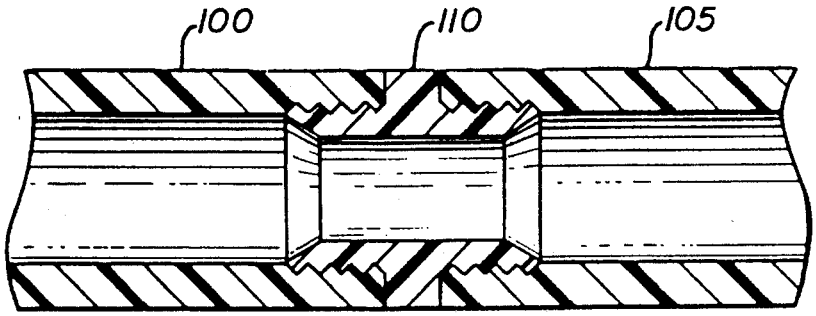

FIG. **6*b* shows a cross-sectional view of the conduit lengths of FIG. 6*a*** coupled with the coupler.

Figure 7:
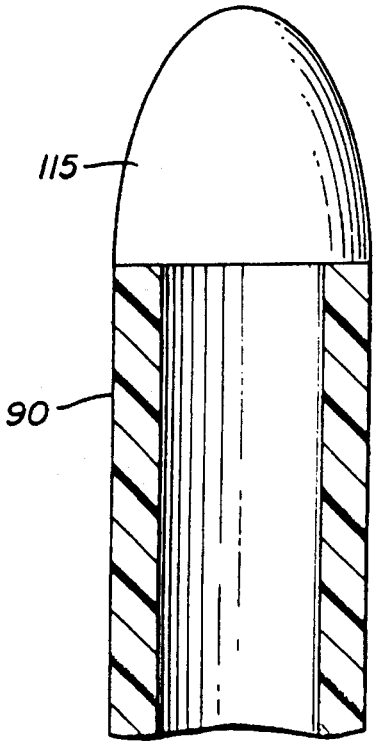

FIG. 7 is a cross-sectional view of the leading end of the conduit used to deliver heating medium to the interior of the tank showing a plug inserted therein to prevent leakage of the contents of the tank as the conduit is being introduced into the tank.

Figure 8:
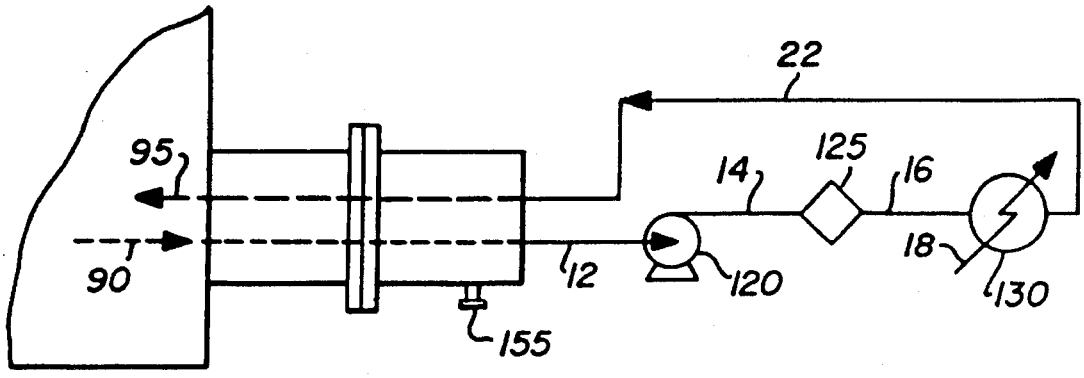

FIG. 8 is a schematic diagram of the direct heating means of the present invention in which it is shown how the heating medium is circulated into and out of the tank.

Figure 9:
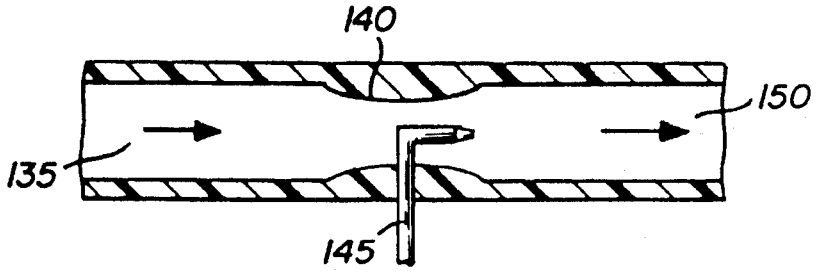

FIG. 9 is a schematic diagram showing a preferred embodiment of the present invention in which the heating medium, in this case water, is heated by steam injected into the conduit carrying the water at a constriction provided in the conduit so as to both heat and increase the velocity of the heated water.

Figure 10:
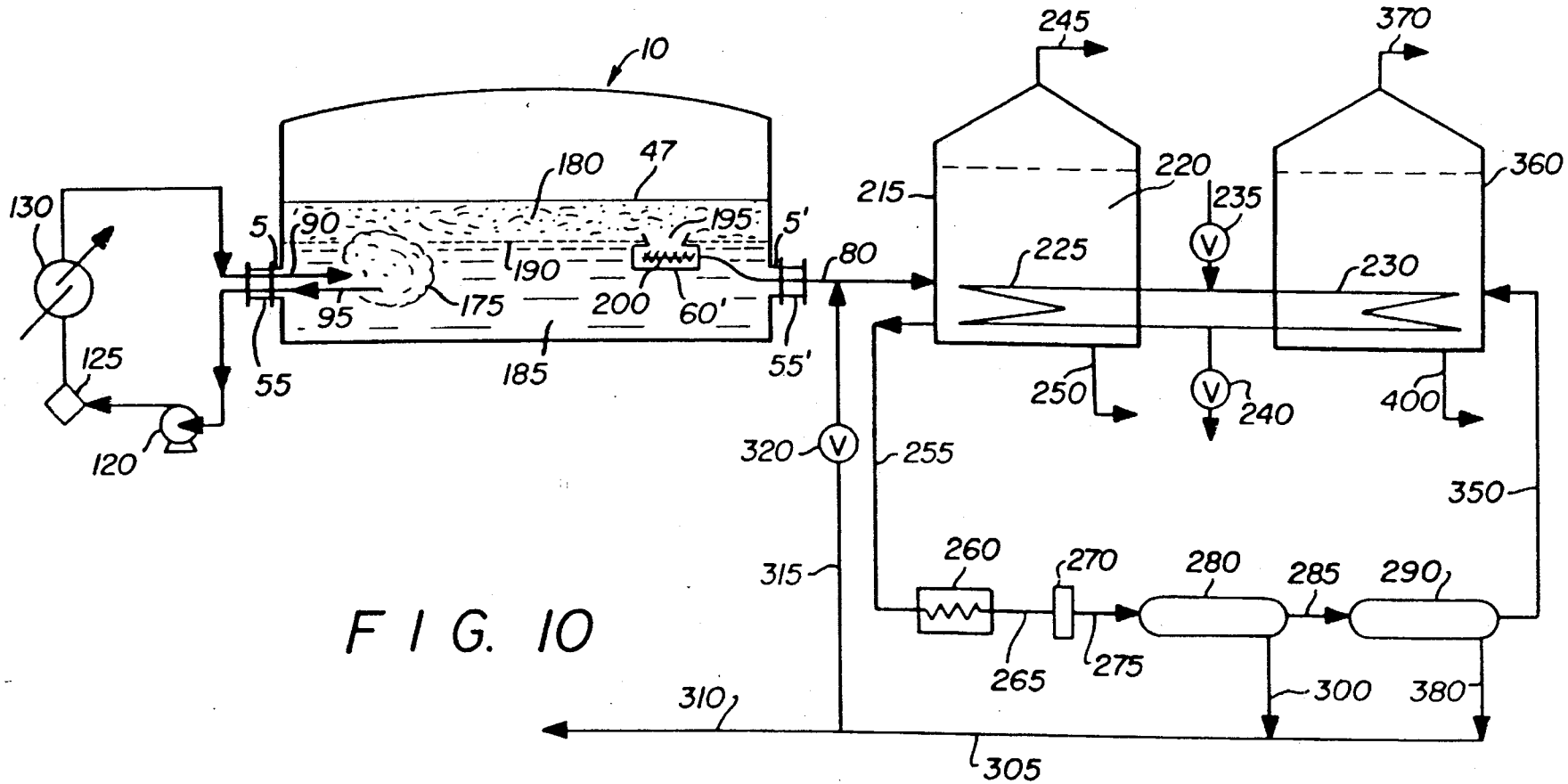

FIG. 10 is a schematic diagram of overall process of the present invention including the mobilization, removal and recovery phases of the process.

Figure 11:
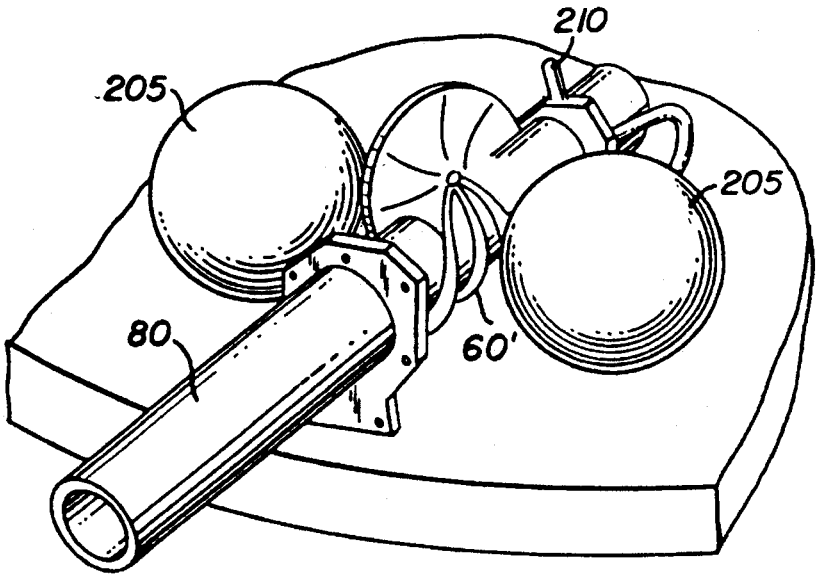

FIG. 11 is an isometric drawing showing the flotation device affixed to the submersible pump.

Figure 12:
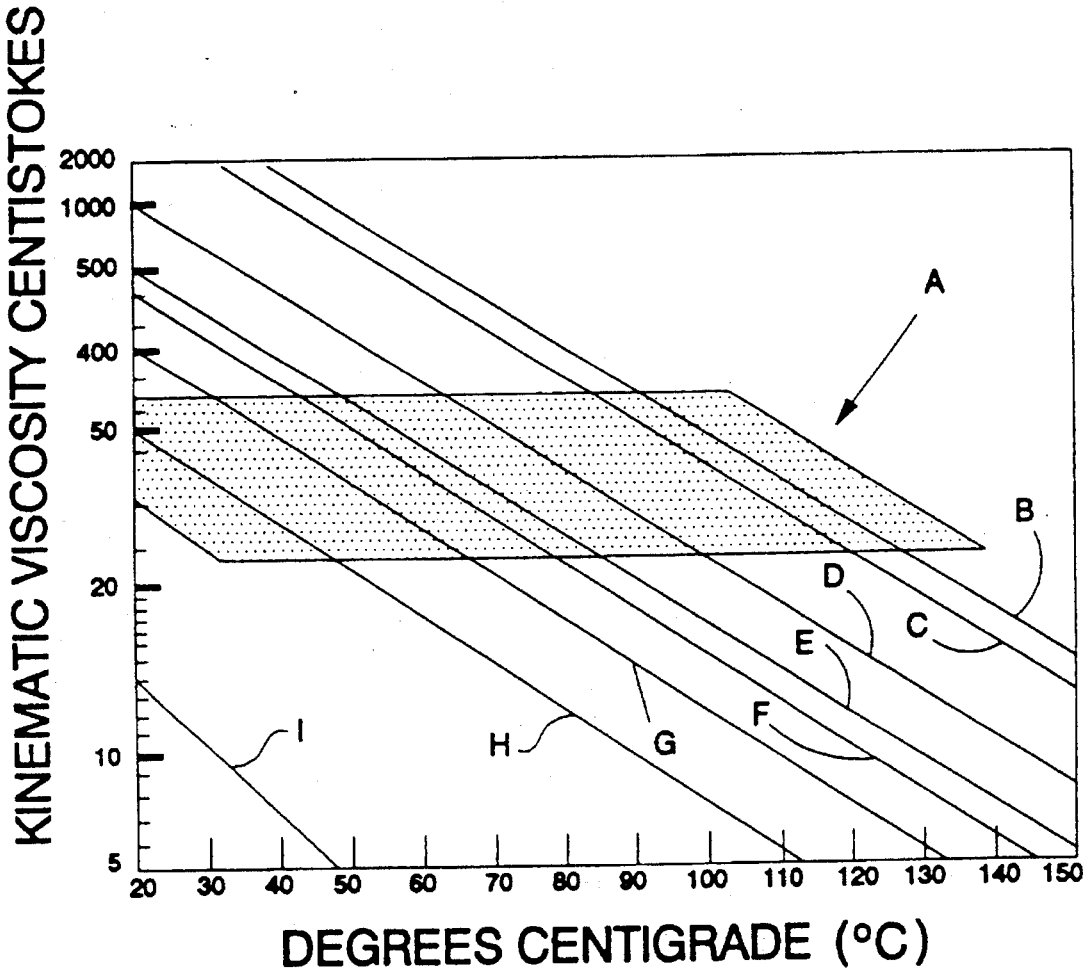

FIG. 12 is a graph showing the effect of temperature (in °C.) upon the kinematic viscosity (in centistokes) of typical residue materials.

DETAILED DESCRIPTION OF THE INVENTION

The present application is specifically directed to processes for thermally mobilizing the tank residue in preparation for its removal; for removing the mobilized residue from the tank; and then treating the removed residue so as to recover a suitable oil product.

More particularly, the present invention involves a first step of thermal mobilization of the residue materials. The thermal mobilization may be effected by direct and/or indirect heating of the black oil residue materials. Regardless of the manner of heating, i.e., whether direct or indirect, the heating means is introduced into the interior of the tank, generally through its manway. With indirect heating, a conduit or the like is provided in which a heating source such as steam, hot water, or hot oil, and the like, is circulated. With direct heating, a heating medium is intimately contacted with the residue material. This heating of the residue material with the heating means lowers its viscosity and thereby enables a residue removal means, such as a submersible pump, to effectively remove the mobilized residue at an optimum pumping and recovery rate.

In view of the relatively high viscosity and possible high solids/sludge content of the residue to be recovered, in a preferred embodiment of the present invention, it is more desirable to have the residue removal means directly introduced into the tank thereby reducing to zero the suction length and thus greatly increasing the handling rate.

The mobilized residue contents of the tank are then continuously removed and fed to a separation zone for the removal of entrained heating medium, if any, and particulate matter. The separation zone may comprise strainers, decanter centrifuges, centrifugal centrifuges and the like. If desired, chemical additives may be employed in the separation zone to assist in the removal of the heating medium, particularly when the medium is water; to reduce the pour point of the recovered hydrocarbons; and to stabilized the hydrocarbons to improve their compatibility with virgin crude oil with which the recovered and treated hydrocarbons may be blended.

Specifically, the present invention is directed to the removal of black oil residues from an enclosed tank which comprises heating at least a portion of the residues by a heating means which is introduced into the tank to the extent that at least that portion of the residue material becomes mobilized. The mobilized residue material is then removed from the tank by means of localized negative pressure located in the tank at the site of the mobilized residue. In a preferred embodiment, the heating means is a liquid medium, advantageously water, which may be introduced into the tank at a velocity and temperature effective to create a localized, mobilized mixture of black oil residue and liquid heating medium. In yet another preferred embodiment, mobilized residue material is removed by a submersible, positive displacement pump, such as an Archimedian screw-type pump, which is capable of being accurately positioned in the tank with the aid of flotation devices attached thereto.

In a further embodiment of the present invention, the removed residue material is treated so as to recover a usable oil therefrom. This recovery process comprises adjusting the temperature of the residue material between about 50° C. to about 200° C. for subsequent filtration and process separation. The heated black oil residues are then subjected to a filtration means to remove coarse particulate matter therefrom and then passed to process separation means whereby substantially all of the water and solid sediments are removed from the filtered black oil residues thereby providing an oil suitable for use as a fuel, or suitable for further refining or blending. The specific temperature at which the residue material is adjusted is dependent on the desired viscosity of the residue material sought during the subsequent filtration and process separation, as well as its viscosity behavior as the temperature of the residue is elevated. In the preferred embodiment, the temperatures of the residue material for the filtration and process separation may range from about 50° C. to about 175° C. A certain amount of trial and error with any sample of the residue material is needed to ascertain the desired operating temperature for the filtration and separation. Of course, that operating temperature is dependent on the viscosity found convenient for the separation apparatus employed. In laboratory practices, one has the choice of a variety of temperatures and temperature of choice will be dependent to great extent on the time allotted for effecting the desire separations.

This overall process provides an efficient and economical means to remove and recover the entrapped hydrocarbon residues from the tank bottoms and brings a source of additional revenue to a refinery in contrast to the prior art in which those same refineries have had to expend considerable sums for the removal and safe disposal of these residues as "waste" material.

By virtue of this overall process, the amount of downtime that a storage tank is subjected to in order to remove its residue content is reduced to a fraction of the time that is conventionally required. Moreover, the use of a closed loop system for thermally mobilizing and removing the residue from the tank presents an environmentally safe process for both the ecology and the personnel involved.

This overall process also includes a novel technique for gaining access to a tank through one of its manways for the introduction of the residue removal means, even when the contents of the tank is at a height which is above the height of the manway. This novel technique for gaining access to the tank by means of its manway is discussed in detail in commonly assigned copending application Ser. No. 07/464,859.

The first phase of the overall process of the present invention is the thermal mobilization of the black oil residues contained within the enclosed tank. As briefly noted earlier, black oil residues, in addition to having variability in chemical composition, form and properties, also have a viscosity ranging from tractability to essentially intractability. This is demonstrated in the Table below which sets forth relevant viscosity properties of a variety of residue samples.

TABLE

| Sample No. | ASTM D2171 Viscosity ~200° F. | ASTM D2171 Viscosity ~150° F. | ASTM D70 Spec. Gravity 150° F. g/ml | ASTM D93 Flash Point °F. corr. to 760 mmHg |
|---|---|---|---|---|
| 2 | 6.4 | 99 | 1.07 | 436 |
| 7 | 6.0 | 203 | 1.09 | 334 |
| 9 | 3.8 | 61 | 1.07 | |
| 15 | 13.3 | 351 | 1.08 | 448 |
| 16 | 3.5 | 360 | 1.09 | Boils, no flash |
| 18 | 10.0 | 167 | 1.09 | Boils, no flash |
| 21 | 11.1 | 698 | 1.11 | Boils, no flash |

Because the residue typically has a high wax content, it exhibits a relatively high pour point, usually about 40° C. and higher. At ambient conditions, the viscosity is not measurable by a standard Brookfield Viscometer because it exhibits a modulus of elasticity. However, when heated, the rigid effect of the wax component is softened to the extent that the material starts to behave as a Newtonian fluid.

Accordingly, to mobilize the residue material within the tank so as to facilitate its removal therefrom, it is necessary to reduce its viscosity by the application of thermal energy. The effect of heat upon a typical sludge composition featuring samples of various marine fuel residues is shown in FIG. 12 which sets forth the relationship of kinematic viscosity as a function of temperature and designates certain of the residues by their International Fuel (IF) number.

The thermal energy is transferred to the residue material by a heating means which is introduced directly into the interior of the tank in contact with the black oil residues. The heating means may comprise indirect or direct heating of the residue material. Indirect heating generally involves the utilization of a heating coil which may be a loop of tubing or piping positioned within the residue material which is heated by a heating source such as steam, hot water, hot oil, electrical energy, and the like, all of which are well know to those skilled in the art.

Preferably, the thermal mobilization of the residue material is accomplished with direct heating in which a heating medium is brought into direct, intimate contact with the residue material. Such direct heating advantageously provides better heat transfer inasmuch as there is no loss of heat to the heating coil itself as in the case of indirect heating. Most importantly, however, direct heating also desirably provides a mixing effect caused by the introduction of the heating medium into the tank as it impinges upon the residue material forming a turbulent mixture of heating medium and mobilized residue material. The creation of such a turbulent mixture greatly enhances heat transfer and the ultimate thermal mobilization of the black oil residues.

The heating medium may comprise steam, hot oil compatible with the residue material, and the like, but most preferably, the heating medium is comprised of hot water. The use of hot water, in contrast to hot oil or some other similar heating medium, provides the advantage of being able to easily separate from the mobilized residue material due to its natural immiscibility and easily form a mobilized residue layer in the tank which floats on top of a water layer. This aids in the subsequent residue removal step in which it is then possible to remove the mobilized residue with only a minimum of entrained water. Of course, water is substantially more economical to use than other heating media.

Regardless of whether the heating means comprises indirect or direct heating of the residue material, the amount of heat that is supplied to the residue material is such that at least a localized portion of the residue material is softened and its viscosity reduced to the extent that it is flowable and capable of being removed from the tank by conventional removal means. Generally, it is desirable to provide a flowable, mobilized residue material having a kinematic viscosity in the range of from about 20 to 100 centistokes, and more preferably in the range of from about 20 to 80 centistokes and a temperature in the range of from about 30° C. to about 100° C., preferably a temperature in the range of from about 50° C. to 95° C.

Frequently, essentially the only tank passageway which is large enough to accommodate the introduction of the heating means, as well as the subsequent introduction of a removal means for the removal of the mobilized residue material, is through one of the manways located on the tank. The manways of these storage tanks are generally designed to accommodate manual entry and accordingly are of a size which can easily accept the introduction of the heating means as well as the residue removal means. Such a manway is schematically shown in FIG. 1 in which manway 5 is mounted on the side of tank 10.

Figure 1:
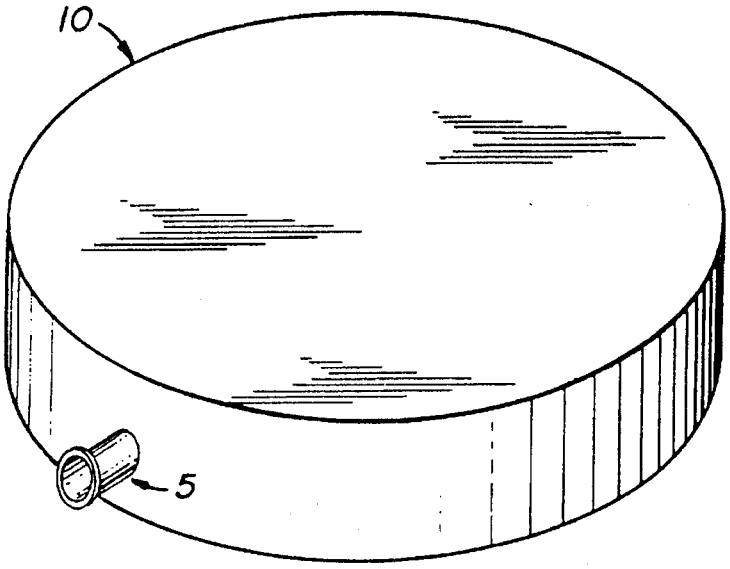
FIG. 1 is a schematic diagram of a storage tank showing a side mounted manway.
Figure 2:
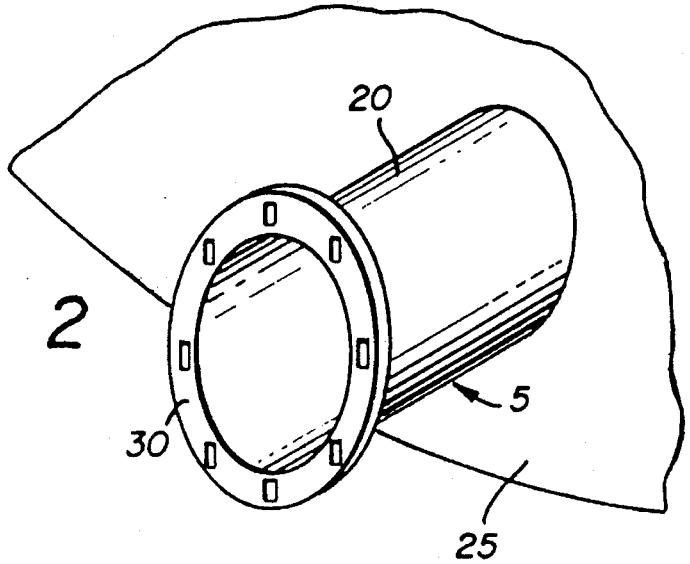
FIG. 2 is a close-up view of the manway shown in FIG. 1.
Figure 3:
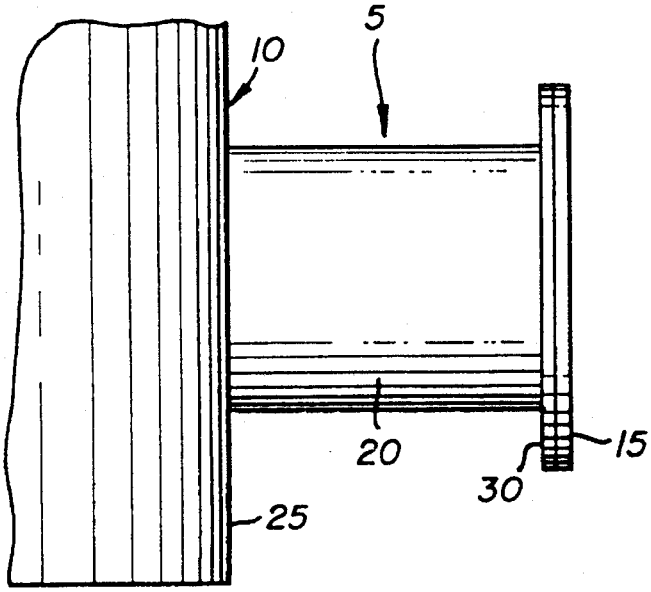
FIG. 3 is a schematic side view of the manway and tank shown in FIGS. 1 and 2.

Referring to FIG. 2, which is a close-up view of the manway of FIG. 1, and to FIG. 3, which is a side view thereof, manway 5 typically comprises an entry neck of housing 20 which is secured to sidewall 25 of tank 10. Manway flange 30 is an integral part of passageway 20 and is the means to which the cover plate 15 is secured to the manway. Cover plate 15 is generally just a "blind flange", i.e., a continuous plate with no openings that communicate with the interior of the tank.

The cover plate of the manway is replaced with an adapter which is provide with means for the introduction of the heating means and/or the removal means. In particular, reference is made to FIG. 4 in which an adapter 35 is shown having an adapter flange 40 which is essentially identical to and preferably mates with manway flange 30. This is to ensure that the adapter will provide a good and effective seal with the manway flange. While it is preferred that the adapter flange be coextensive and mate with the manway flange, it is not necessary that it do so.

Figure 4:
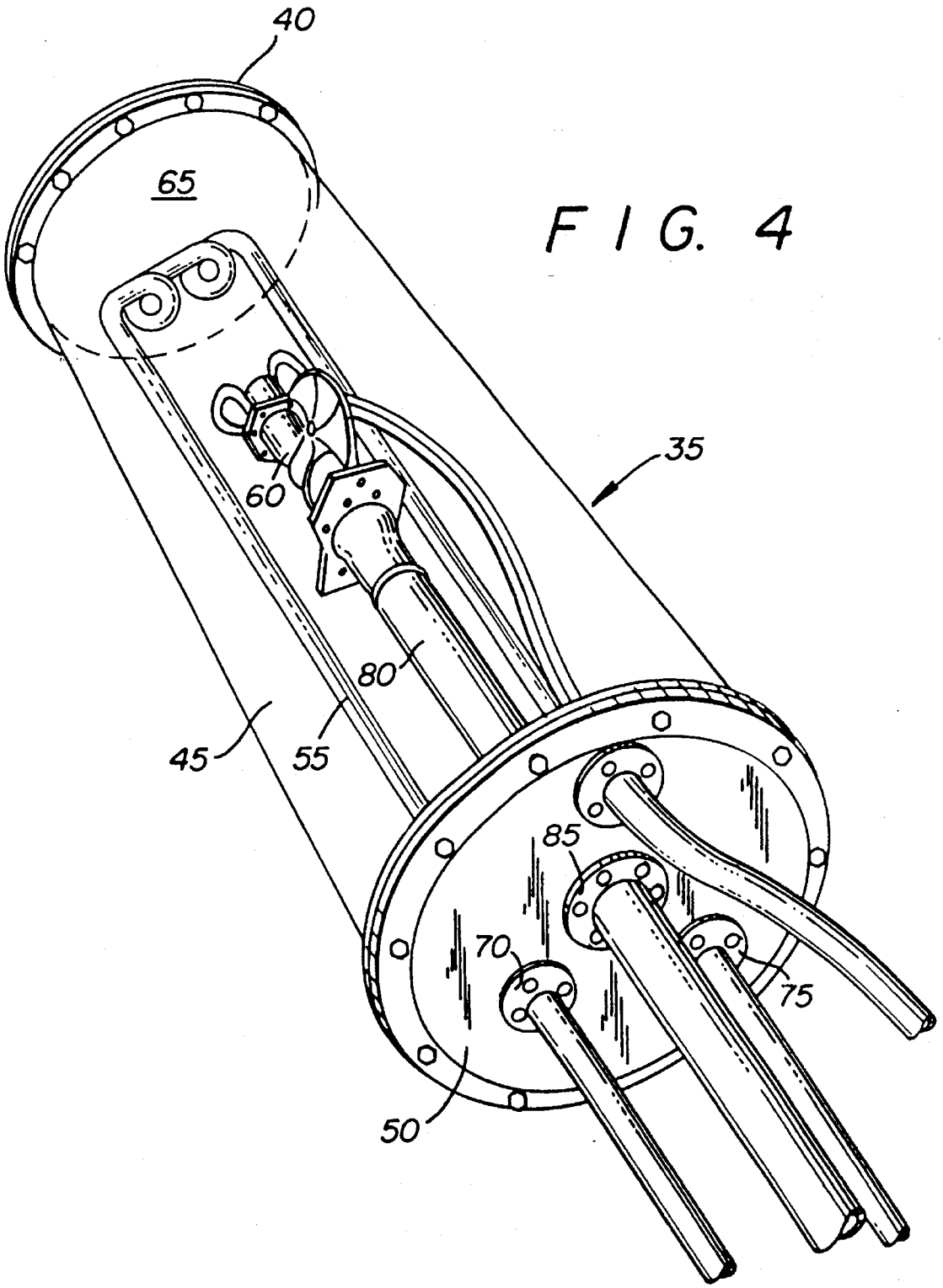
FIG. 4 is an isometric view of an adapter which is affixed to the manway of the tank and which shown the embodiment of the present invention in which indirect heating means are positioned within the housing of the adapter in conjunction with removal means.

Adapter 35 is additionally comprised of a housing 20 and a front face 50. Housing 20, in accordance with the present invention, is equipped with indirect heating means 55 and removal means 60, which in FIG. 4 is shown as a submersible pump, which represents the preferred embodiment of the present invention. By providing the heating and removal means within housing 20, it is a simple matter to then subsequently introduce these elements directly into the tank such that it is in direct contact with the residue material by passage through back face 65 of the adapter which is open, freely communicates with, and allows complete access to the interior of the tank.

Front fact 50 of adapter 35 is provided with opening means which allow for communication between the inside and outside of the tank. These openings may be comprised of valves, seals, or other conventional opening means well known to those skilled in this art. In FIG. 4, seals 70 and 75 allow for the conduit of heating means 55 to enter and leave the adapter thereby enabling the introduction of the hot heating source through, for example seal 70 and for the withdrawal of the cooler heating source through seal 75 if, as discussed above, the indirect heating source is comprised of steam, hot water, hot oil or some other suitable heating material. This heat source is continuously recirculated through the conduit of heating means 55 by means of a pump (not shown) which passes the cooler heat source from seal 75 to an external heat exchanger (not shown) so that it may be suitable reheated for reintroduction into the tank via seal 70. The external heat exchanger may be supplied with any conventional heating supply for reheating the heat source of indirect heating means 55.

Generally, the heat source will be heated to a temperature in the range of from about 30° C. to about 100° C., preferably to a temperature of about 50° C. to about 95° C. Of course, if the heat source for heating means 55 is electrical energy, pump or external heat exchanger is required and the current is supplied continuously at the proper level to ensure a proper temperature.

The conduit of heating means 55 is slideably mounted in the seals such that it can be moved in the direction of back face 65 and into the tank to come into contact with the residue material. The heating means may be moved by hand of by some other suitable means, such as hydraulically.

Similarly, removal means 60 is also slideably mounted in seal 85 and is capable of moving at least in the direction of back face 65 by moving discharge conduit 80 which is connected to removal means 60 and passes through seal 85 and though which mobilized residue material is withdrawn.

It is to be understood that although FIG. 4 illustrates both the heating means and the removal means being present in the one adapter, it is also quite acceptable, and indeed perhaps more desirable, to have the removal means positioned in one adapter and the heating means in another adapter which is attached to another one of the manways of the tank.

Figure 5:
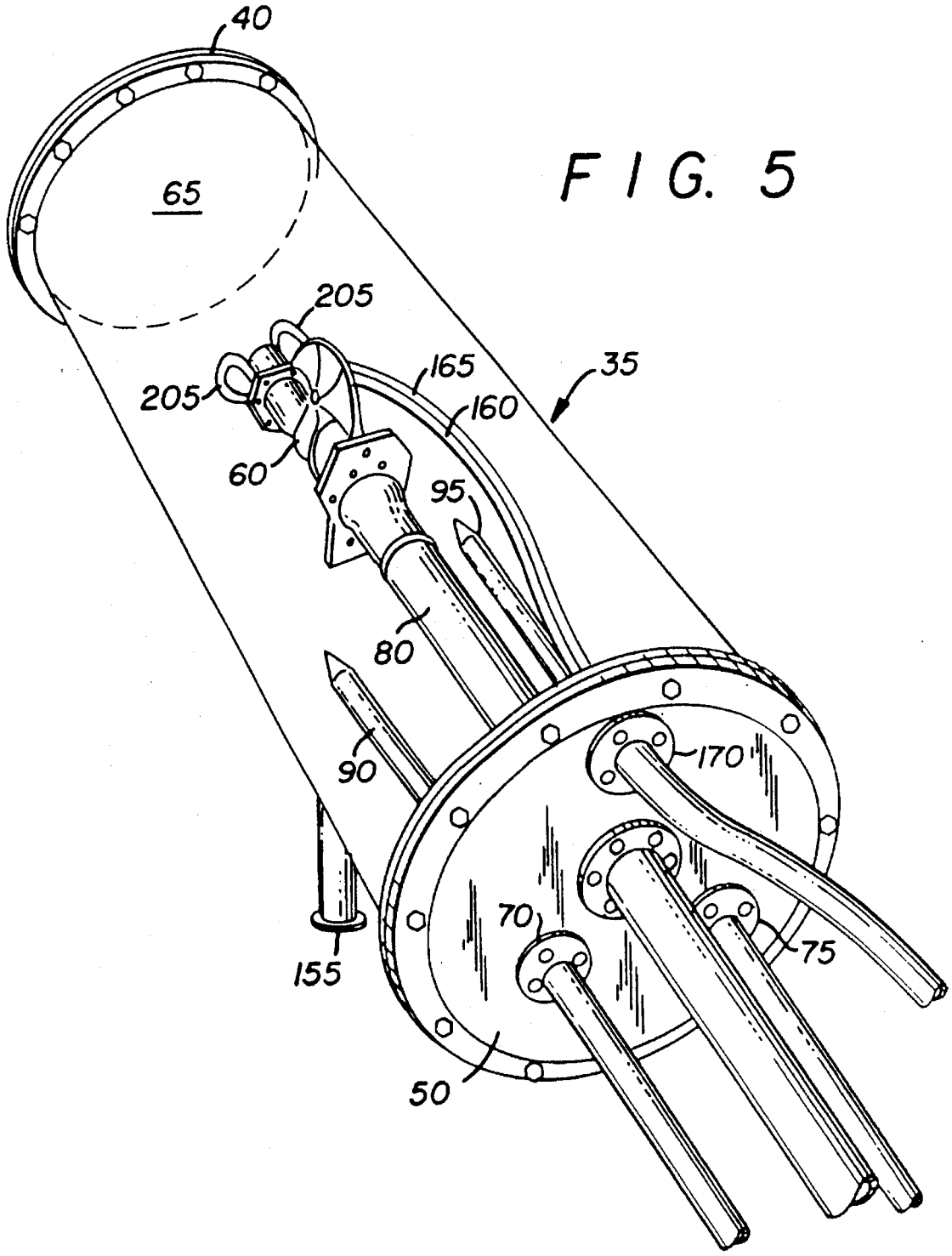
FIG. 5 is the same as FIG. 4 with the exception that the heating means shown is a direct heating means in accordance with another preferred embodiment of the present invention.

FIG. 5 is essentially the same as FIG. 4 with the exception that the heating means here is a heating medium which comes into direct, intimate contact with the residue material and is recirculated into and out of the tank by means of conduits 90 and 95.

Conduits 90 and 95 (as well as the conduit of heating means 55 of FIG. 4) may be comprised of any suitable material which will not be susceptible of corrosive attack by the black oil residues and be able to additionally withstand the temperature and pressure conditions of the process. Suitable materials include stainless steel, nickel alloys, and the like. Particularly suitable are plastic pipes which are coupled together at regular intervals by threaded couplers as shown in FIGS. *6a* and *6b* which shows a length of conduit 100 having threaded end 101 being joined to a length of conduit 105 having threaded en 106 by threaded coupler 110. Such coupling of the conduits facilitate ease of replacement lengths should a breakage occur thereby presenting only a minor interruption in the process due to the simple threaded coupler technique. Other methods for joining these conduits is within the contemplation of the invention.

Similar to the embodiment shown in FIG. 4, conduits 90 and 95 and slideably mounted in seals 70 and 75, respectively, such that they can be moved in the direction of back face 65 of adapter 35 for introduction into the interior of the tank and insertion into the viscous black oil residues.

During insertion in to the residue, it is desirable that the leading ends of each of conduits 90 and 95 be sealed off with lightweight end-plugs 115, typically made of wood, as shown in FIG. 7 so as to prevent leakage of the tank's contents during the insertion process when the heating medium is not yet being transported through the conduits.

The end-plugs are only push-fitted into the conduit ends such that when the heating medium is introduced through the conduits, the end-plugs are displaced and float clear. Conduits 90 and 95 are typically hand fed into the tank. It should be noted that the conduits may even be introduced into the adapter via the opening seals in the front face of the adapter after it has been affixed to the manway. It is not necessary that these conduits already be present in the housing of adapter prior to its being secured to the manway.

Referring to the embodiment shown in FIG. 8, the hot heating medium is introduced via conduit 95 which is positioned inside of the tank and within the black oil residue at the side desired. The leading end of the conduit may be advantageously tapered to increase the local velocity of the heating medium as it leaves the conduit. The direct impingement of the hot heating medium with the residue material causes a turbulent mixing action to occur which provides for improved heat transfer and better mobilization of the residue material. Generally, the total amount of heating medium introduced into the tank before circulation is begun is in the range of from about 30 to 120 volume percent of the volume of black oil residue present in the tank, preferably about 50 to 100 volume percent, and most preferably about 100 volume percent. In other words, in the most preferred embodiment of the present invention, the heating medium, most desirably water, is added to the tank in a volume equal to that of the black oil residues present in the tank.

The heating medium is preferably introduced into the residue at a velocity of from about 2 to about 15 m./sec., and preferably about 5 to about 10 m./sec. at a temperature of no greater than about 95° C., and preferably no greater than about 90° C., when water is used as the heating medium so as to prevent any cavitation that may occur at higher temperatures. If another heating medium is utilized, its temperature will be adjusted to provide for a desired residue temperature which temperature will be enough to facilitate mobilization but not so high as to be economically unattractive.

Referring to FIG. 8, once the desired amount of heating medium has been introduced into the tank, recirculation is then begun. The heating medium and any entrained residue material leaves the tank via conduit 90 and enters circulating pump 120 via line 12. Circulating pump 120 may comprise any pump having good solids handling capabilities, for example, a centrifugal pump. The heating medium leaving pump 120 via line 14 is then desirably filtered by passage through a low pressure drop filter 125, to remove possible debris collected by the heating medium in its passage through the tank. From filter 125, the filtered heating medium enters heat exchanger 130 via line 16 in which it is heated by any suitable means such as by steam, and the like, entering through line 18. The heated heating medium is then reintroduced into the tank via line 22 and conduit 95.

As an alternative embodiment, if the heating medium is water, the water may be reheated to its appropriate temperature by the technique shown in FIG. 9. There, relative cool water enters a conduit via entrance 135 in the direction shown by the arrow and into a constriction 140 of the conduit in which a steam inlet means 145 is provided. The combination of the constriction and the introduction of the steam in the direction of water flow provides for the heating of the water in conjunction with an increase in its velocity. This accordingly desirably reduces the power consumption required by circulating pump 120.

Although the embodiment shown in FIG. 5 and 8 describe conduit 95 being utilized for the introduction of hot heating medium and conduit 90 is utilized for the withdrawal of cooler heating medium, it is also suitable to utilize both conduits 90 and 95 for the introduction of the heating medium and connect line 12 of FIG. 8 to discharge means 155 for the withdrawal of the cooled heating medium from the tank.

As the heating means is circulated into and out of the tank, more and more of the residue material surrounding the localized turbulent zone containing the mixture of mobilized residue material and heating medium at the site where the heating medium is introduced, becomes mobilized. Eventually, even those parts of the residue material which are not in the immediate vicinity of the turbulent zone start to become more and more mobilized. 0f course, it is preferable to move conduits 90 and 95 to different locations within the tank so as to hasten the residue mobilization.

Generally, after about 4 to 8 days (for a tank of about $5\times10^6$ to $20\times 10^6$ gallons), the temperature of the residue material is just about in equilibrium with the temperature of the heating medium. At least in the case of water, a mobilized residue layer is formed floating on top of a water layer. In the case of a heating medium other than steam or water, although some separation into layers may occur, generally a mixture of the heating medium and the mobilized residue will be present.

The previous discussion has assumed that the contents of the tank, prior to the replacement of the manway cover plate with the adaptor, is at a height which is lower than the lowermost portion of the manway. In that case, there is no concern of any leakage of the tank's contents caused by the removal of the cover plate. However, if the contents of the tank are a level which is higher than the lowermost portion of the manway, than the accessing technique discussed and claimed in application Ser. No. 07/464,859, and which is a part of the overall process of the present invention, is used. Thus, by virtue of the accessing technique, the cover plate of a manway can be removed and replaced with an adapter without any appreciable loss of the contents of the tank even when the contents are at a level which is above the height of the entire manway.

This technique involves first inserting a blanking plate between the cover plate and the manway flange to which the cover plate is secured and securing the blanking plate to said flange. The cover plate is then removed while the blanking plate is still in position and effectively retains the contents of the tank in place. The adapter is then placed in position and secured to the manway flange as well. The blanking plate is then removed and the recovery process is ready to begin.

Once the black oil residue material has been mobilized to the extent desired, it is then ready for removal from the tank by the removal means so that it can be processed and usable oil recovered therefrom.

The removal means 60, shown in FIGS. 4 and 5 as a submersible pump, may be any suitable pump which is capable of handling a relatively viscous material and possibly containing a high concentration of particulate material as well. Generally, a positive displacement type pump is preferred. A standard immersion skimmer type pump which is designed for oil recovery in marine applications may be used. A particularly desirable pump is an Archimedian screw-type, self-cleaning pump sold by the Environmental Division of A B Pharos Marine, Gothenburg, Sweden.

Most preferably, the submersible pump is inserted directly into the tank. In view of the relatively high viscosity and possible high solids content of the materials to be removed, it is more efficient to have the pump be directly in the tank thereby reducing to zero the suction length, and thereby greatly increasing the handling rate.

As shown in FIG. 5, the submersible pump is connected to discharge conduit 80 through which the mobilized black oil residues are withdrawn. Depending upon whether the heating means utilized is direct or indirect, the withdrawn residue material may also contain entrained heating medium as well, such as water.

The pump is hydraulically driven for safety reasons with hydraulic fluid entering and leaving via lines 160 and 165, respectively, which pass through seal 170 in front face 50 of the adapter.

Discharge conduit 80 may be used, with the aid of portable hydraulic means, for example, (not shown) to advance the pump forward towards back face 65 and into the tank by any desired distance The specifics of the track means upon which the pump travels are discussed in commonly assigned patent application Ser. No. 07/464,867.

Once the pump is introduced inside of the tank, it is desirable positioned such that its inlet end is a least slightly above the interface formed, if any, between the heating medium, such as water, and the mobilized residue material. In this manner, the minimum quantity of water is entrained with the withdrawn residue material while that part of the residue material which is the most mobilized is still withdrawn due it is close proximity to the generally hotter water layer.

More specifically, reference is made to FIG. 10 in which a tank 10 is shown having two manways 5 and 5' to which adapters 35 and 35' are affixed, respectively. Through adapter 35, conduits 90 and 95 continuously introduce and withdraw heating medium to and from the interior of the tank creating a turbulent region 175 in which a mixture of the mobilized residue and heating medium exists. With time, depending upon the particular heating medium used, which is preferably water, a relatively mobilized layer of residue material 180 is formed which floats on a layer of water 185 forming a residue/water interface 190. It will be appreciated that the residue material closest to interface 190 will be relatively warmer than the residue material located a surface 47 of the residue layer with a temperature gradient existing from surface 47 to interface 190. Correspondingly, the viscosity of the residue material at the interface will be lower resulting in better handling properties. Accordingly, the inlet end of the removal means is desirably positioned slightly above interface 190 to withdraw the warmer, more mobilized residue material, but may be positioned anywhere within residue layer 180 as is desired and consistent with the removal capabilities of the pump.

Referring to FIG. 10 again, top hopper opening 195 of pump 60' is positioned slightly above interface 190. Archimedian screw 200 in pump 60' is connected to and driven by hydraulic motor (not shown) by means of hydraulic lines 160 and 165 (shown in FIG. 5). The pump may be accurately positioned within the tank both in the vertical and horizontal planes. Movement parallel to the axis of the manway in the horizontal plane of the tank is accomplished by the extent of introduction of discharge conduit 80. Movement in the vertical plane is accomplished by inflating and deflating flotation bags 205 which are attached to pump 60' as shown in FIGS. 4 and 11. These flotation bags are inflated by introducing compressed air or nitrogen through conduit 210 passing through a seal (not shown) in front face 50 of adapter 35 and can thereby accurately raise or lower the pump accordingly. Of course, all of the conduits connected to the pump must be made so as to be flexible enough to accommodate such vertical and horizontal movement.

The pump is operated simultaneously with the heating means once the residue material is sufficiently mobilized, so as to continuously heat the residue material in order to maintain it in a mobilized condition while continuously removing the thusly mobilized residue and processing it for oil recovery.

Pump 60' creates a negative pressure at its inlet end, i.e., hopper 195, through which the mobilized residue material enters and is withdrawn via discharge conduit 80.

Although it is preferred in the present invention to actually introduce the pump into the tank, it is nevertheless acceptable to keep the pump outside of the tank and simply introduce a conduit into the tank which is connected to the inlet, suction side of the pump. Generally, in order to remove the residue material in this matter, the residue viscosity must be in the range such that the suction head between the inlet end of the conduit and the external pump inlet is entirely acceptable for good pumping practice. In such cases, the conduit which is inserted through a seal in the front face of the adapter is curved so as to allow for hand positioning of the conduit to locate the mobilized residue/water interface.

Having mobilized the residue material and recovered it from the tank, the black oil residue is now ready to be treated so as to recover a usable oil.

From conduit 80, the residue material, alone or in a mixture with heating medium such as water, is conveyed to a holding tank 215. The contents 220 of tank 215 are kept liquid and flowable by the addition of sufficient heat through coil 225 and recirculation by conventional mans (not shown) to avoid cold spots in the tank. Coil 225 may be a steam line connected with coil 230 and fed through valve 235. Steam or condensate are removed through a valve 240. Of course, electric heating coils may be employed instead of the steam.

To assure that the transported black oil residues are maintained through the separation process at the desired temperature, the process desirably employs either insulated or heat traced lines throughout.

Trapped gases in the black oil residues have an opportunity to be released in tank 215. to the extent they are released, they are vented from the tank through line 245. Water or other liquid heating medium which settles from the residue body 220 in tank 215 is purged through line 250.

Residue 220 is thereafter removed through line 255 from tank 215 into heat exchanger 260. The purpose of heat exchanger 260 is to fine tune the temperature of the residue which is to be subjected to the subsequent steps of the process. In the typical case, heat exchanger 260 is of a straight through tube and shell construction. Heat exchanger medium, such as mineral oil, steam, and the like, may be employed in either the tube or shell side of exchanger 260. Usually, the exchanger is used to raise the temperature of the residue to a degree which optimizes the later separation steps. As pointed out above, this comprises adjusting the temperature of the residue material between about 50° C. to about 200° C. for subsequent filtration and process separation. Therefore, it is preferred that the residue leaving the exchanger through line 265 be at such a temperature, most preferably at a temperature between about 50° C. to about 175° C. This facilitates the later separation steps and enhances the purity of the eventual oil product obtained by the process. The heated black oil residues are then subjected to a filtration means to remove coarse particulate matter therefrom and then passed to process separation means whereby substantially all of the water and solid sediments are removed from the filtered black oil residues thereby providing an oil suitable for use as a fuel, or suitable for further refining or blending. The specific temperature at which the residue material is adjusted is dependent on the desired viscosity of the residue material sought during the subsequent filtration and process separation, as well as its viscosity behavior as the temperature of the residue is elevated. A certain mount of trial and error with any sample of the residue material is needed to ascertain the desired operating temperature for the filtration and separation. Of course, that operating temperature is dependent on the viscosity found convenient for the separation apparatus employed. In laboratory practices, one has the choice of a variety of temperatures and temperature of choice will be dependent to great extent on the time allotted for effecting the desire separations.

The treatment of the mobilized black oil residues may be effected in a variety of ways. The desirable treatment typically involves a vigorous combination of filtration, decantation and centrifugation such that a large proportion of the particulate solids content of the inorganic (especially and primarily siliceous) and organic (especially and primarily carbonaceous) varieties and water are removed to a level which meets certain critical fuel specifications. Surprisingly, this first stage can be achieved without causing the separation also of significant mounts of the wax and asphaltenes contents. A critical balance is thus achieved between the stability of the treated residues, which allows them to be used as a fuel, the economic value of the treated residue insofar as it retains much of its fuel value after treatment, and purity of the treated residues which is tied to the combination of its utility as a fuel, its handling properties and general corrosivity. Operative systems for the treatment of the residues can be found in the following documents distributed by Alfa-Laval AB, Separation Engineering Division, S-147 00 Tumba, Sweden—

1. technical brochure no. TB 41009 E/8506, entitled: "Alfa-Laval Waste Oil Recovery,"
2. technical brochure entitled: "Decanter Centrifuge for continuous 3-phase separation of slurries type NX 418 B-11," and
3. technical brochure entitled: "Slop Oil Treatment Plant For Crude Oil Recovery."

The heated residue is passed through line 265 into filter 270 which serves to remove coarse, insoluble particles in the residue in the millimeter size range. This avoids clogging and undue wear in subsequent processing equipment. As noted in the aforementioned literature, there are a variety of decanters and centrifuges that one may employ to complete the treatment of the residue. For example, after filtration, the partially treated residue may be passed through line 275 to a low speed decanter centrifuge 280 of a typical commercial design. The purpose of the low speed decanter centrifuge 280 is to effect a substantial portion of the separation of the residue into further treated residue, heating medium (typically water), and solids of the carbonaceous and inorganic varieties. A desirable low speed decanter centrifuge possesses a horizontal conocylindrical rotor equipped with a screw conveyor. The residue is fed into the rotor operating about 2,000 to about 3,500 rpms through a stationary inlet tube and accelerated by an inlet distributor to achieve the centrifugal forces to generate the required sedimentation of the solids in the residue. The solids are conveyed to the conical end and are lifted clear of the liquid component of the residue. The clarified portion of the residue is carried overflow into the vessel through openings in the cylindrical end of the rotor. The "purified" residue leaves the cylindrical big end of the decanter. The "purified" residue from the decanter centrifuge 280 is moved through line 285 into another but higher speed decanter centrifuges 290 or to a higher speed vertical disc stacked centrifuge 290'. In this respect, the separation may be achieved using an Alfa Laval disc stack laboratory centrifuge, model no. LA PX-202, which is set such a way at a operational unrefined residue temperature of 120° C. to produce separation to a maximum of 10 microns of BS (basic sediments), 0.6% w/w water and 0.1% w/w suspended solids. For oils with a very high sludge content, a two-stage operation, comprising a decanter centrifuge followed by a disc-stack separator is also convenient. The principles of these decanter centrifuges may be found in FIG. 7 of the Alfa Laval technical brochure no. TB 41009 E/8506, entitled: "Alfa-Laval Waste Oil Recovery, of the decanter centrifuge and the principles of its operation. Another system for separation may be found in the Alfa Laval technical brochure entitled: "Slop Oil Treatment Plant For Crude Oil Recovery. This brochure provides for the use of an Alfa-Laval NX decanter, a WHPX self-cleaning separator, plate heat exchangers, such as the NX 414B-31 Decanter Centrifuge, and it is used in series with a WHPX 513 Self-cleaning Separator.

Sediment and heating medium, such as water, are removed from the decanter centrifuge 280 by a line not shown. In case of an emergency, residue not effectively treated in centrifuge 280 can be discharged out of the system via lines 300, 305, and 310, or be recycled back to tank 215, via line 315 by the opening of valve 320. The vertical disc stacked centrifuge 290' (substituting for the decanter centrifuge 290) may be a bowl type centrifuge such as those described in the art. The higher speed centrifuges 290 and 290' operate at speeds of about 5,000 to about 7,000 rpms.

After filtration, the partially treated residue is passed through line 275 to a low speed decanter centrifuge 280. The purpose of the decanter centrifuge 280 is to effect a substantial portion of the separation of the residue into further treated residue, heating medium (typically water), and solids of the carbonaceous and inorganic varieties. A desirable decanter centrifuge possesses a horizontal conocylindrical rotor equipped with a screw conveyor. The residue is fed into the rotor operating about 2,000 to about 3,500 rpms through a stationary inlet tube and accelerated by an inlet distributor to achieve the centrifugal forces to generate the required sedimentation of the solids in the residue. The solids are conveyed to the conical end and are lifted clear of the liquid component of the residue. The clarified portion of the residue is carried overflow into the vessel through openings in the cylindrical end of the rotor. The "purified" residue leaves the cylindrical big end of the decanter. Illustrative of such a decanter centrifuge is the type NX 418 B-11 made by Alfa-Laval Separation A/S, Soeborg, Denmark. The "purified" residue from the decanter centrifuge 280 is moved through line 285 into another but higher speed decanter centrifuges 290 or to a higher speed vertical disc stacked centrifuge 290'.

Sediment and heating medium, such as water, are removed from decanter centrifuge 280 by a line not shown. In case of an emergency, residue not effectively treated in centrifuge 280 can be discharged out of the system via lines 300, 305, and 310, or be recycled back to tank 215, via line 315 by the opening of valve 320.

The vertical disc stacked centrifuge 290' (substituting for the decanter centrifuge 290) is a bowl type centrifuge such as the WHPX 405 TGD separator sold by Alfa-Laval Separation AB-SCE, Tumba, Sweden.

The higher speed centrifuges 290 and 290' operate at speeds of about 5,000 to about 7,000 rpms.

After the final separations have been effected in either centrifuge 290 or 290', the final purified residue is fed through line 350 into tank 360 which is heated by coil 230 as described above in respect to tank 215. Saleable product is removed via line 400 for blending with other hydrocarbon materials of for further refining. Removable gases are vented through line 370.

Separator 290 is provided with emergency line 380 which allows cycle back of residue to tank 215 via lines 305 and 315 or discharge out of the system via lines 305 and 310.

If it is desired, prior to blending the oil product with other petroleum materials or even used as is, the recovered oil product may be chemically treated with, for example, pour point depressants and/or surface active wetting agents.

A wide variety of special chemicals can be used a pour point depressant for the recovered oil but those that give assurance of stability under a variety of use conditions contemplated for fuel applications are pour point depressants based on copolymer of vinylacetate and a monoolefin of 2 to 3 carbon atoms. In the preferred embodiment, the olefin is ethylene. A preferred copolymer composition contains olefin in the amount of from about 40 to 90 mole % of the copolymer and vinylacetate comprises about 10 to 60 mole % of the copolymer. The copolymer may contain a small amount, such as up to 5 mole %, of a terpolymeric component such a alkyl (1–4 carbon atoms) acrylates and methacrylates, vinyl alkanoates where the alkanoates are higher than acetate, vinyl alkylethers, styrene, alpha-methylstyrene, and the like materials.

These copolymeric pour point depressants may have a number average molecular weight of about 2500 to about 10,000 preferably about 3,500.

Other pour point depressants which are well known to those skilled in the art may also be used, alone or in combination with the copolymer pour point depressant discussed above.

Generally, one employs enough of the pour point depressant to reduce the pour point of the recovered oil by about 3° C. to about 10° C. When this level of pour point reduction is achieved, there is a noticeable improvement in the suppression of the precipitation tendencies of the recovered oil.

The surface active wetting agents that may be used are those formed as adducts of an alkylene oxide (oxirane structure) and a hydroxyl containing compound. Preferred surface active wetting agents are derived from alkoxylation with a vicalkyleneoxide such as ethyleneoxide alone or in combination with 1,2-propyleneoxide of phenolic compounds such as bishpenol A and a phenolic capped phenolfolmaldehyde novolac resin having a number average molecular weight between about 232 and 5,000 preferably between about 500 and 3,500.

The amount of the surface active wetting agent added to the recovered oil is not critical and may range from about as low as 0.5 to a few parts per million parts of the residue, even up to about 10,000 parts per million parts of recovered oil.

What is claimed is:

1. A process for the mobilization and removal of black oil residue from an enclosed storage tank comprising the steps of:

a) introducing a heating medium into the black oil residue at a velocity and temperature effective to create a localized turbulent mixture of mobilized black oil residue and heating medium and an adjacent area of mobilized black oil residue;

b) removing the mobilized black oil residue from the adjacent area and from the tank by localized negative pressure located at the portion of the residue which has become mobilized;

c) heating the removed mobilized black oil residue to a temperature in the range of between about 50° C. to about 200° C.;

d) feeding the heated black oil residue to a filtration means to remove coarse particulate matter therefrom; and c) passing the filtered, heated black oil residue to process separation whereby substantially all solid sediments and any residual heating medium contained in the filtered black oil residue are removed thereby producing an oil suitable for further refining or blending.

2. The process of claim 1 wherein the black oil residue in step a) is heated by indirect heating with a conduit which is in contact with the residue.

3. The process of claim 2, wherein a source of heat for the indirect heating is steam, water, oil or electrical energy.

4. The process of claim 3, wherein the source of heat is at a temperature in the range of from about 30° C. to about 100° C.

5. The process of claim 1, wherein the black oil residue is heated by direct heating with a heating medium.

6. The process of claim 5, wherein the heating medium is water.

7. The process of claim 6, wherein the water is at a temperature which is less than about 95° C.

8. The process of claim 1, wherein the residue is mobilized when its viscosity is in the range of from about 20 to 100 centistokes.

9. The process of claim 1, wherein the heating means before step a) is introduced into the tank through at least one tank manway.

10. The process of claim 1, wherein the negative pressure is provided by a submersible pump having an inlet end located at the mobilized black oil residue.

11. The process of claim 10, wherein the pump employs an Archimedian screw design.

12. The process of claim 6, wherein a layer of mobilized black oil residue is formed over a layer of water and the localized negative pressure is located at the interface formed by the said residue layer and the water layer.

13. The process of claim 10, where the pump is introduced into the tank through at least one tank manway.

14. The process of claim 1, wherein the temperature of the black oil residue is maintained at a temperature in the range of between about 75° C. to about 175° C. throughout the process.

15. The process of claim 1, wherein the process separation comprises a decanter centrifuge.

16. The process of claim 15, wherein the process separation comprises a low speed and high speed decanter centrifuge in sequence.

17. The process of claim 1, wherein the process separation comprises a high speed vertical disc stack centrifuge.

18. The process of claim 1, wherein the process separation comprises the sequence of a decanter centrifuge and a high speed vertical disc stack centrifuge.

19. The process of claims 15 or 18, wherein the decanter centrifuge effects a continuous separation of insoluble particulate matter and heating medium from the filtered black oil residues in a horizontal conocylindrical rotor equipped with a screw conveyor.

20. The process of claim 1, wherein the heating medium is introduced at a velocity in the range of from about 2 to about 15 m./sec.

21. The process of claim 1, wherein the heating medium is introduced at a temperature in the range of from about 30°

C. to about 100° C.

22. The process of claim 1 wherein the combination of steps a) and b) are replaced by the steps of:

i) inserting one or more conduits through at least one manway of the tank such that at least the leading end of the conduit is in contact with the black oil residue;

ii) introducing water at a temperature of less than about 95° C. through the conduit at a velocity of about 2 to about 15 m./sec. such that a localized turbulent mixture of mobilized black oil residue and water is created;

iii) withdrawing water from the tank, reheating it to a temperature of less than 95° C., and then reintroducing the heated water to the tank through at least one conduit;

iv) continuing to withdraw and reintroduce the water until a layer of mobilized black oil residue is formed on top of a layer of water within the tank forming a residue/water interface;

v) introducing a submersible pump having a discharge conduit by means of a tank manway and positioning its inlet end at least slightly above the residue/water interface; and vi) removing the mobilized black oil residue from the tank through the discharge conduit of the pump.

23. The process of claim 22, wherein the volume of water in the water layer is substantially equal to the volume of black oil residue contained in the tank.

24. The process of claim 22, wherein the submersible pump employs an Archimedian screw design to transport the mobilized black oil residue.

* * * * *